United States Patent [19]

Moriwaki et al.

[11] Patent Number: 4,604,993

[45] Date of Patent: Aug. 12, 1986

[54] VIBRATORY MASSAGE DEVICE

[75] Inventors: Hiroshi Moriwaki; Yukio Yamamura, both of Hikone; Kazuhiko Fujikawa, Mie, all of Japan

[73] Assignee: Matsushita Electric Works, Ltd., Japan

[21] Appl. No.: 560,849

[22] Filed: Dec. 13, 1983

[30] Foreign Application Priority Data

Jan. 31, 1983 [JP] Japan ..... 58-14149

[51] Int. Cl.[4] ..... A61H 21/00

[52] U.S. Cl. ..... 128/24.2; 128/36; 128/54; 128/56

[58] Field of Search ..... 128/24.1, 24.3, 35–38, 128/47, 54–56

[56] References Cited

U.S. PATENT DOCUMENTS

| | | | |
|---|---|---|---|
| 923,234 | 6/1909 | Acton | 128/35 |
| 942,299 | 12/1909 | Wiking | 128/35 |
| 1,113,079 | 10/1914 | Wilmes | 128/35 |
| 1,723,268 | 8/1929 | Conill | 128/35 |
| 2,067,979 | 1/1937 | Newton | 128/24.2 |
| 3,468,304 | 9/1969 | Teranishi | 128/36 |
| 3,503,395 | 3/1970 | Meyer | 128/24.2 |
| 3,710,785 | 1/1973 | Hilger | 128/36 |

FOREIGN PATENT DOCUMENTS

| | | |
|---|---|---|
| 195939 | 2/1907 | Fed. Rep. of Germany . |
| 213040 | 10/1908 | Fed. Rep. of Germany . |
| 299415 | 6/1914 | Fed. Rep. of Germany . |
| 1095987 | 12/1960 | Fed. Rep. of Germany . |
| 2750799 | 5/1979 | Fed. Rep. of Germany . |
| 44-20391 | 9/1969 | Japan . |
| 44-20392 | 9/1969 | Japan . |

OTHER PUBLICATIONS

"Kaltleiter messen, schalten und heizen", *Funkschau,* by Peter Kleinschmidt, Dr. Hans Meixner, 1981, pp. 71–75.

*Primary Examiner*—Clyde I. Coughenour

*Attorney, Agent, or Firm*—Stevens, Davis, Miller & Mosher

[57] ABSTRACT

A vibratory massage device with a heating element is disclosed. The device includes a housing with an upwardly extending shaft means, an applicator head connected by the shaft means to the housing so as to be supported thereby, and a heating element arranged within the applicator head. The applicator head has a top face generally perpendicular to the axis of the shaft means and a side face generally parallel to that axis, and is driven to effect vibrations transverse to that axis with respect to the housing. The top face of the applicator head, when placed against the area of a human body, will move substantially in the plane of that portion during the above vibratory motion so as to apply a rubbing massage action thereto, while the side face, when placed against the body, will vibrate in the direction generally perpendicular to the area of the body so as to apply a tapping massage action thereto. Said top face and one part of said side face are defined respectively by a rigid top face and rigid side face to both of which the heat from the heating element is applicable, whereby the operator can enjoy a combined heat-massage treatment in each of the rubbing and tapping massages. In addition to the above, the other part of said side face is defined by a resilient side face capable of being compressibly deformed when placed against the body such that a relatively gentle tapping massage can be obtained by utilizing the resilient side face as a body-contacting surface, in contrast to that a relatively strong tapping massage can be obtained by utilizing the second rigid member to be engaged with the area of the body.

1 Claim, 10 Drawing Figures

VIBRATORY MASSAGE DEVICE

BACKGROUND OF THE DISCLOSURE 2 1. Fields of the Invention

This invention is directed to a vibratory massage device, more particularly, a hand held vibratory massage device with heating facility.

2. Description of the Prior Art

Vibratory massages device combined with heating facility have been provided in the past for enhancing massaging treatment. Such prior art devices are shown, for example, in Japanese Utility Model Publication Nos. 44-20391 and 44-20392. In these prior devices, an applicator head includes a heating element together with an eccentric flyweight which is secured on a rotary shaft to be driven thereabout for producing vibrations in the plane perpendicular to the rotary shaft. The applicator head is generally employed in two different massaging modes depending on the area of a human body or the demand by an operator, one is for rubbing massage treatment to utilize the top face or the surface perpendicular to the axis of the shaft as a body-contacting surface which moves substantially in the plane of the area of the body upon the vibratory motion of the head, and the other is for tapping massage action to utilize the side face or the surface parallel to that axis as a body-contacting surface which apply a tapping force to the body upon the vibratory motion of the head. In the above prior devices, however, the heating element is disposed at the location adjacent either to the top face for use in the rubbing massage or alternatively to the side face for use in the tapping massage. Therefore, the heating treatment is limited to be added to only one of the above two massages, and cannot be added to each of the rubbing and tapping massage actions, restricting the applicability of the heating treatment and failing to satisfy the operator who may desire to receive a combined heat-massage treatment both in the rubbing and tapping massages. Another prior device is shown in U.S. Pat. No. 2,067,979 in which a heating element is arranged adjacent the under side of a dome shaped applicator defining the top face of a vibrator head. The vibrator head is so designed as to move generally in the direction perpendicular to the plane of the top face, effectuating a tapping massage action only by utilizing the top face as a body-contacting surface. In other words, it is not expected from this device to utilize both top and side faces for the above different massage actions. Consequently, the heat from the heating element can be understood to be applied only to the top face and is not applied to the side face, rendering the device unsatisfactory in the sense of the above discussion.

SUMMARY OF THE INVENTION

The above disadvantages or drawbacks have been eliminated by the present invention which comprises an applicator head having a top face for rubbing massaging purpose and a side face for tapping massage purpose, a housing with an upwardly extending connecting shaft means for supporting the applicator head, and a heating element disposed within the applicator head. Disposed within the applicator head is a vibration-generating source which is operatively connected to a drive means in the housing to be driven thereby for causing the applicator head to effect vibrations transverse to the axis of the shaft means with respect to the housing. During this vibratory motion of the applicator head, the top face when placed against an area of a human body will move substantially in the plane of that area to apply a rubbing massage action thereto, and the side face when placed against an area of the human body will move repeatedly to-and-fro substantially perpendicular to that area so as to apply a tapping massage action thereto. The top face of the applicator is defined by a rigid top face to which the heat from said heating element is applicable and one part of the side face is defined by a rigid side face to which the heat is likewise applicable, making it possible to apply the heat to the area of the body along with the massage action irrespective of whether the rubbing massage or the tapping massage action is selected. In addition to the above, the present invention provides a unique and useful feature in which the other part of the side face defined by a resilient side face capable of being compressibly deflected when urged against the body, whereby the strength applied to the body in the above tapping massage can be adjusted depending upon such parts of different deformability being utilized selectively to be placed against the body, that is, when the part of the rigid side face is selected for use, a relatively strong tapping massage force can be obtained as compared to a relatively gentle tapping massage force being obtained when the part of the resilient side face is selected.

Accordingly, it is a primary object of the present invention to provide a vibratory massage device which can give a combined effect of heat and massage treatments upon the area of the body in each of the rubbing mode and the tapping mode as well as can effectuate adjusting the strength of the tapping massage force applied to the body only by selecting the part of the side face of the applicator head to be placed against the body.

In the preferred embodiment of the present invention, said rigid top face is integrally formed with the rigid side face to extend continuously from the top face to the part of side face of the applicator head, and is made of the material of relatively higher thermal conductivity in order to attain rapid heat transfer from the heating element to the above two rigid faces immediately after the conduction of the heating element.

It is therefore another object of the present invention to provide a vibratory massage device with a heating facility in which only one heating element is enough for heating both the top face and the part of the side face which should be located on different sides of the applicator head for applying heat respectively in each of the rubbing and tapping massages, and in which the heating treatment can come immediately in use without substantial warm-up time.

A further advantageous feature of the present invention resides in the employment of a positive temperature coefficient thermistor as the heating element, such thermistor having inherently the self temperature control functions as well as requiring less rise time. This serves to prevent the above rigid faces from being excessively heated and yet to heat the above rigid faces more rapidly.

It is therefore a further object of the present invention to provide a vibratory massage device with heating facility which eliminates the danger of the applicator head being heated excessively without any additional protecting means.

In the preferred embodiment of the invention, said rigid side face and the resilient side face are respectively designed to have rounded circumferences of substantially the same curvature such that each of the side faces can readily and comfortably fit the body contour to apply an effective tapping massage action. Said rigid top face is shaped to be at least slightly convex in all directions and curves integrally into the rounded rigid side face so as to leave a spot thereunder at the location adjacent to the rigid side face for receiving said heating element, and said spot for the heating element is disposed intermediate both longitudinal ends of a member constituting rigid top and side faces. With this arrangement, the heating element is readily attached by face-bonding to the under side of said member and yet can transfer its heat almost uniformly without a substantial temperature gradient therebetween.

The above and other advantages of the present invention will be better understood from the following detailed description when considered in connection with the accompanying drawings.

DETAILED DESCRIPTION OF THE PREFERRED EMBODIMENT

Figure 1:
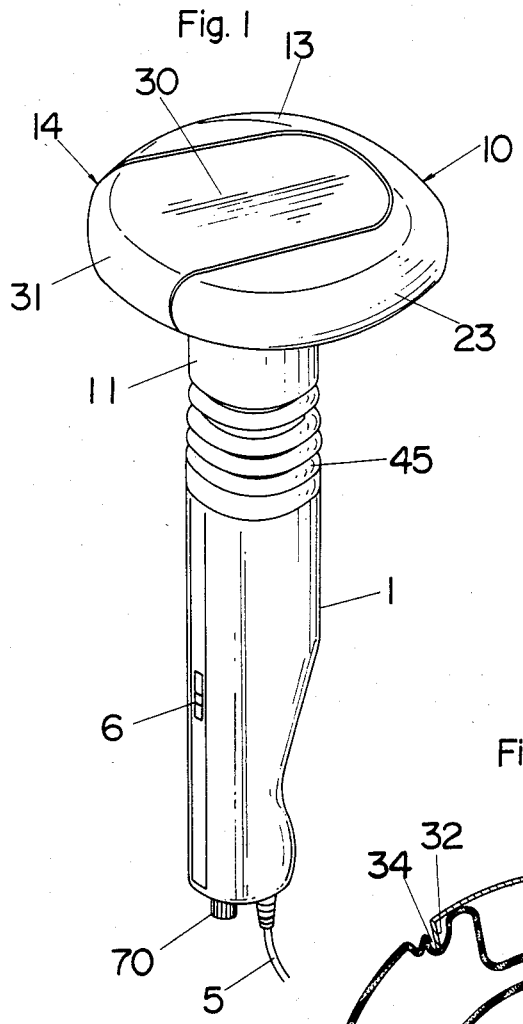
FIG. 1 is a perspective view illustrating a vibratory massage device in accordance with the preferred embodiment of the present invention.
Figure 2:
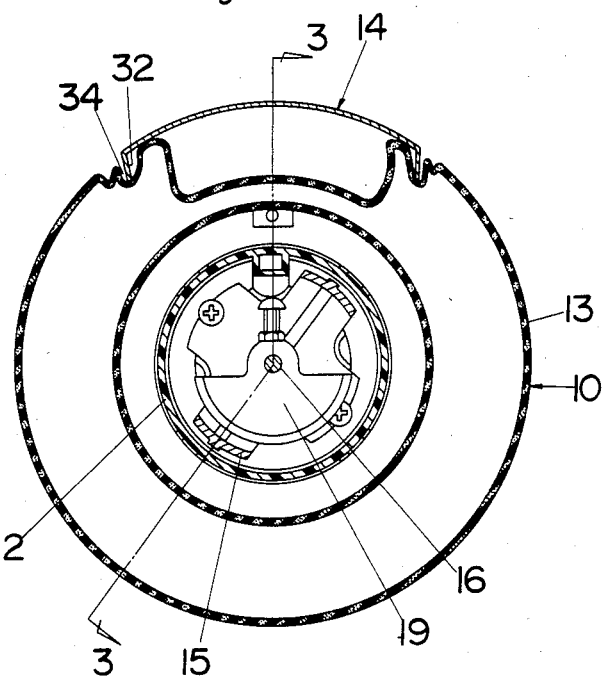
FIG. 2 is a transverse sectional view illustrating an applicator head and a flyweight employed in the above massage device.

Referring now to the drawings and particularly to FIGS. 1 through 4, there is illustrated a vibratory massage device in accordance with the present invention which includes a generally cylindrical hollow housing 1 forming a handle to be grasped by the hand of an operator and an applicator head 10 supported thereby. Disposed within the housing 1 is an electric motor 2 which has an output rotary shaft 3 coaxial with the housing 1. The motor 2 is connected through an electric circuit 4 to an electric source by means of a power cord 5 extending through the lower end wall of the housing 1 and energized by the operation of a switch knob 6 on one side of the housing 1.

Figure 3:
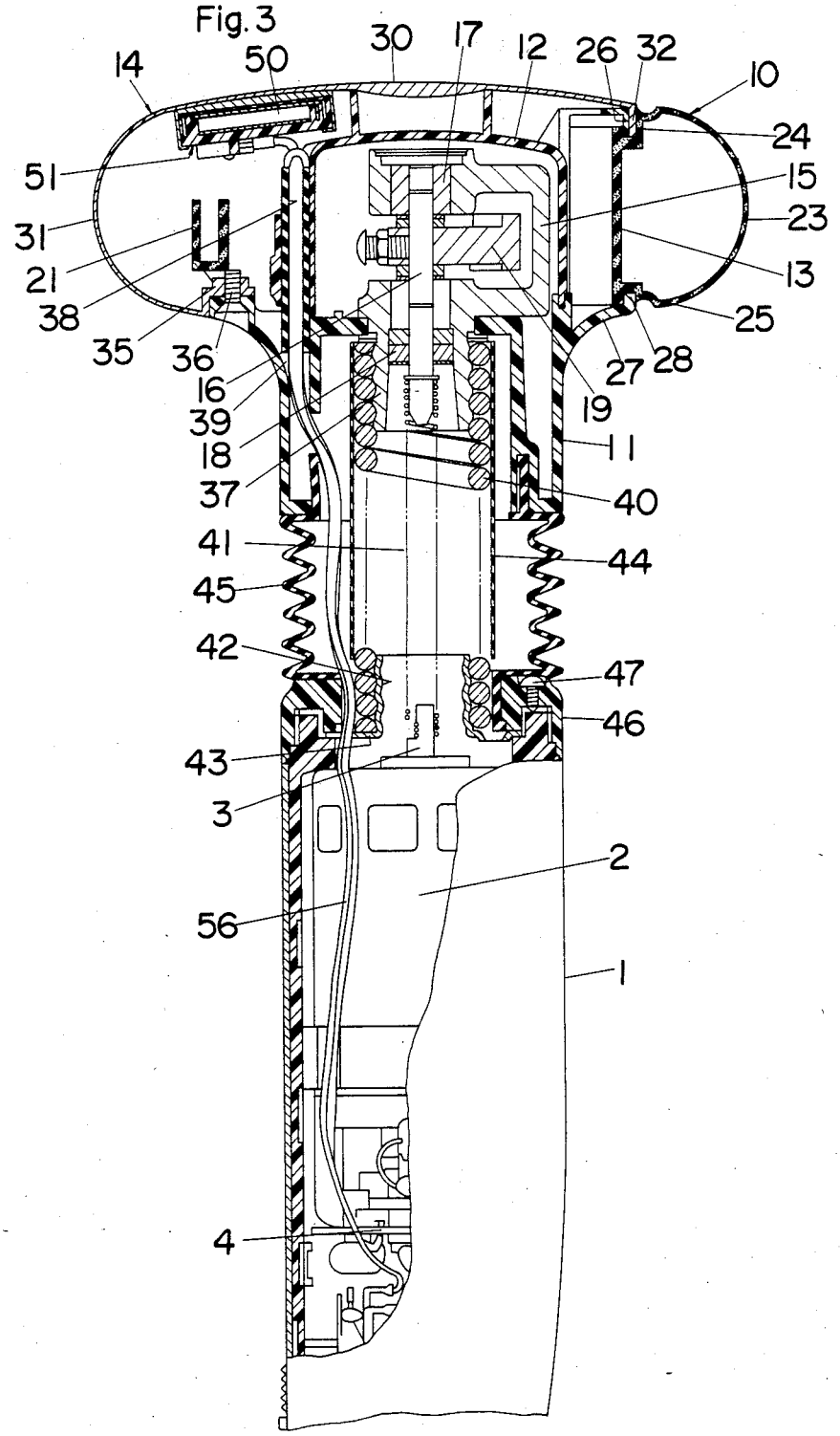
FIG. 3 is a longitudinal sectional view, partially in elevation, of the massage device as taken along line 3—3 of FIG. 2.
Figure 4:
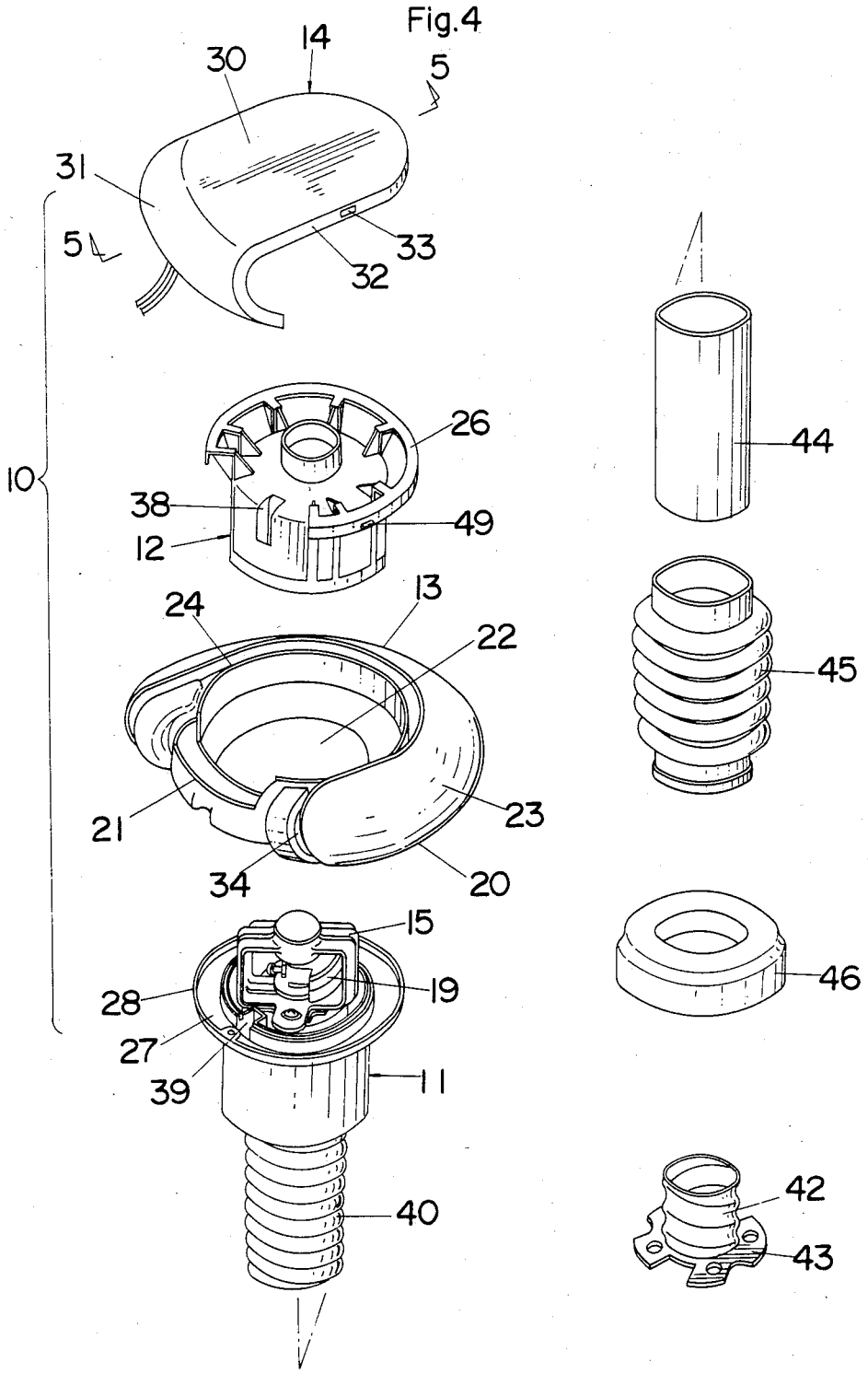
FIG. 4 is an exploded perspective view illustrating an applicator head and a connecting shaft means employed in the above device.

Said applicator head 10 comprises, as best shown in FIGS. 3 and 4, a base barrel 11, a core cap 12, a generally torus shaped annulus 13, and a cover plate 14 of rigid material. Mounted fixedly on the upper wall of the base barrel 11, made of a durable synthetic resin such as polyoxymethylene, is a bearing bracket 15 which includes a drive shaft 16 rotatably journaled therein by a bearing 17 and bushes 18. The drive shaft 16 is coaxial with said output shaft 3 and connected thereto by means of a flexible coil spring 41 to be driven by the motor 2. An eccentric flyweight 19 is carried on the drive shaft 16 to produce vibrations transverse to the axis of the drive shaft 16 upon rotation of the shaft 16.

Said annulus 13 is made of a resilient material capable of being compressibly deformed, for example, of soft polyethylene and comprises a generally C-shaped band 20, when viewed in plane, of hollow construction and a narrow rib 21 integrally bridging between both ends of the band 20 to define an opening 22 inwardly thereof. The band 20, as shown in FIG. 3, has a generally D-shaped cross-section with the rounded side facing outwardly to define a rounded and resilient side face 23 of the applicator head 10, thus the resilient side face 23 is capable of being compressibly deformed in the radial direction of the applicator head 10 when placed against the area of a human body to be massaged. The annulus 13 is also provided in its upper surface adjacent closely to the inner edge thereof with an upper groove 24 surrounding the top edge of the opening 22 and is also provided in its lower surface with an lower groove 25 likewise surrounding the bottom edge of the opening 22. Said core cap 12, being made of the same durable material as the above base barrel 11, encloses the bearing bracket 15 projecting upwardly from the base barrel 11 and has an outwardly and upwardly extending integral rim 26 the lower edge of which fits snugly into the upper groove 24 of the annulus 13 to fasten the core cap 12 coaxially thereto. Fitted into the lower groove 25 is an upwardly projecting peripheral edge 28 provided on the outmost portion of a flange 27 extending outwardly from said base barrel 11 for uniting coaxially these two members. Said cover plate 14 is made of aluminium having a relatively rigid characteristic as well as high thermal conductivity to have a generally U-shaped cross section of an elongated top face portion 30 being slightly convex in all directions and a rounded side face portion 31 which has the same curvature of said resilient side face 23. The top face portion 30 closes the upper opening of the annulus 13 and defines a rigid top face of the applicator head 10 which is engageable with the area of the body to be massaged, while the rounded side face portion 31 covers said narrow rib 21 of the annulus 13 to define a rigid side face which is cooperative with said resilient side face 23 to present the entire side face surrounding the applicator head 10. The rigid side face 31 and the resilient side face 23 are respectively engageable with the area of the body and is selected to be placed against that area depending upon the types of massage to be applied, as described hereinafter. Extended inwardly from the periphery of the cover plate 14 is a hem 32 with slots 33 into which hooks 49 on said rim 26 of the core cap 12 snap respectively so that the cover plate 14 is secured via the core cap 12 to the annulus 13. One part of the hem 32 is received in said upper groove 24 together with said rim 26 and the rest portion thereof is received in another groove 34 extending from upper to the lower surface of the annulus 13. A tab 35 at the lower end of said rounded side face portion 31 is provided for securing the annulus 13 to said base barrel 11 by a screw 36.

A tightly coiled stiff spring 40 is employed as a connecting shaft means for interconnecting the applicator head 10 and the housing 1. The upper end of the coil spring 40 is securely threaded onto a hub 37 extending integrally from said bearing bracket 15 and downwardly through the upper wall of said base barrel 11 to be secured thereto. Into the lower end portion of the coil spring 40 is securely threaded a sleeve 42 with a flange 43 which is in turn secured to the upper end of the housing 1. The coil spring 40 thus connected between the housing 1 and the applicator head 10 surrounds said flexible coil spring 41 to be coaxial therewith, such that the axis of the coil spring 40 or the connecting shaft means is substantially perpendicular to the top face of the applicator head 10 in its normal condition. A protective rubber sheath 44 fits intimately onto the substantial portion of the coil spring 40 and a bellows 45 is interposed between the housing 1 and the applicator head 10. The numeral 46 designates a shoulder ring threaded onto the upper side wall of the housing 1 and secured thereto by a screw 47 to enclose said flange 43.

Figure 7:
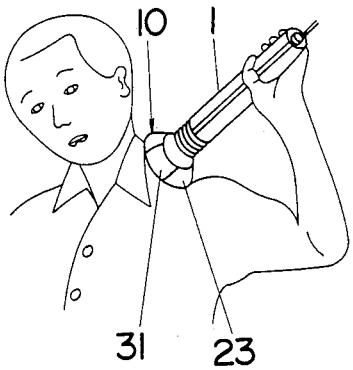
FIGS. 7 through 9 are somewhat schematic views respectively illustrating the use of the above vibratory massage device on the area of a human body for different massaging purposes.
Figure 8:
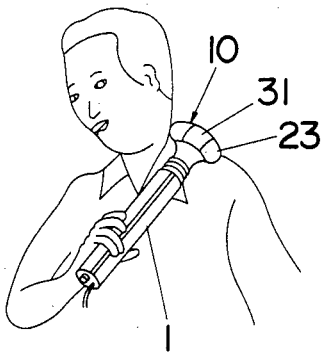
Figure 9:
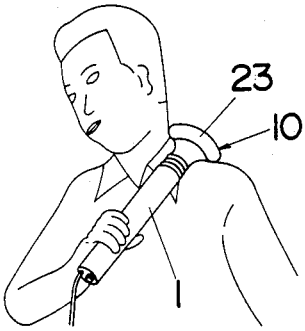

Upon rotation of the eccentric flyweight 19 about the drive shaft 16 by the energization of the motor 2, the coil spring 40 allows the applicator head 10 to vibrate with respect to the housing 1 in the directions transverse to the axis of said coil spring 40, more exactly, it vibrates substantially in the plane perpendicular to the axis of coil spring 40 with minor possible vibrations at angles with respect to that axis, performing a somewhat orbital motion with respect to the housing 1. Accordingly, when the top face of the applicator head 10 is for use to be placed against the area of the human body, as illustrated in FIG. 7, the top face moves substantially in the plane of that area to apply a rubbing massage action thereto. On the other hand, when the side face of the applicator head 10 is placed against the area of the body during the above vibration, as illustrated in FIGS. 8 and 9, the side face of the applicator 10 moves to-and-fro substantially perpendicular to that area to apply a tapping force thereto. In this connection, when the resilient side face 23 of the applicator head 10 is selected to be placed against the body, a relatively gentle tapping massage treatment is obtained due to the deformability of the resilient side face 23, as compared to the case when the rigid side face 31 is selected to apply a relatively strong tapping massage force to the body.

Figure 5:
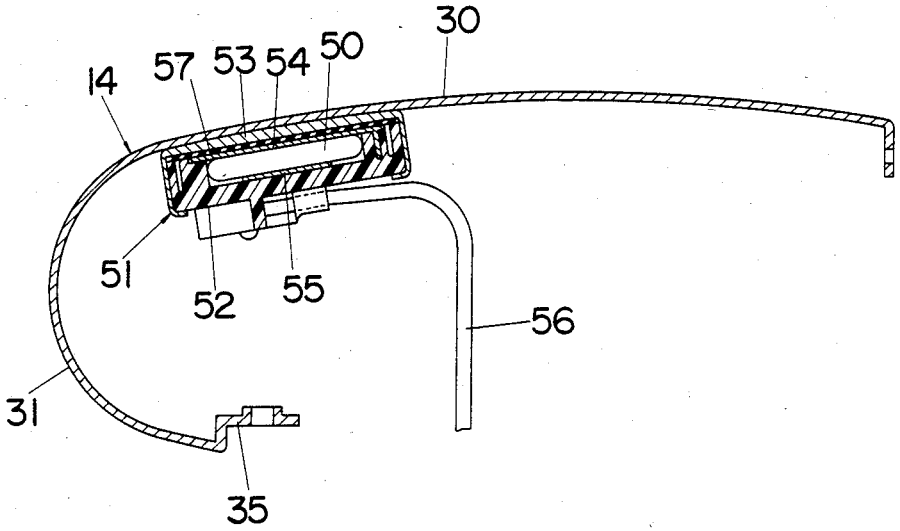
FIG. 5 is a cross sectional view taken along line 5—5 of FIG. 4.

Also included in the applicator head 10 is a heating element 50 to apply along with each of said massage actions heat to the area of the body being massaged. The heating element 50 in the present embodiment is a positive temperature coefficient thermistor (PTC) received together with a pair of terminal plates 54 and 55 in a flat case 51 composed of a mold 52 of electrical insulating material and an aluminium cap 53 of relatively high thermal conductivity, as best shown in FIG. 5. Both conducting surfaces of the heating element (PTC) 50 is kept in contact with the terminal plates 54 and 55, which are connected to said electric circuit 4 in the housing 1 by means of a pair of lead wires 56 covered with an insulating sheath. Said cap 53 covering the upper opening of the mold 52 and holding the same abuts on its entire upper surface to the under side of the cover plate 14 of the applicator head 10 to transfer the heat from the heating element 50 efficiently to the cover plate 14 which is the body-engaging surface member, and it is bonded thereto by a suitable adhesive of high thermal conductivity, for example, epoxy resin filled with metal oxides. A film 57 of electrically insulating material is inserted between the upper terminal plate 54 and the cap 53 to prevent the electrical conduction therebetween with a minimum loss in the above heat transfer. As shown in the same figure, the cap 53 is in contact with the under side of the cover plate 14 at the location closely adjacent to said rounded side face portion 31. Such location is apparent from the figure to have a less curved or nearly plane surface and to be intermediate the ends along the elongated length of the cover plate 14, such that said face-bonding between the cap 53 on the side of heating element 50 and the cover plate 14 is easily attained as well as that the heat from the heating element 50 is transferred almost uniformly to each of the top face portion 30 and the side face portion 31. Said lead wires 56 extending from the heating element 50 pass through a first vertical channel 38 in the peripheral portion of said core cap 12, a second vertical channel 39 in the base barrel 11, and the space between the bellows 45 and the rubber sheath 44, to enter the housing 1 so as to be connected to said electric circuit 4 disposed therein. As described above, the employment of the PTC heater of higher heat generating capacity as the heating element 50 results in a simple construction of the applicator head 10 in which only one heating element is enough for heating each of said rigid top face 30 and said rigid side face 31 which are to be utilized respectively for different massaging purposes as fully discussed hereinafter. PTC has another important characteristic of performing self-temperature control function to automatically decrease the amount of current flowing therein as the temperature increases, so that the temperature is kept at a predetermined level. It is therefore a further advantage resulting from the employment of PTC heater that the self-temperature control performance characteristic of a PTC heater will eliminate the necessity of adopting any additional temperature control component such as a thermostat, rendering the device to be simple in construction and therefore to be easily assembled.

Figure 6:
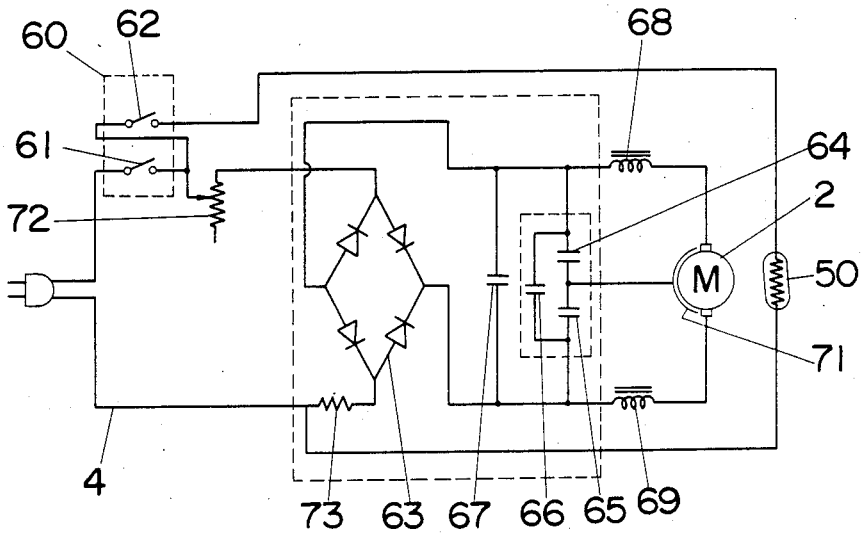
FIG. 6 is a schematic wiring diagram illustrating the electrical connections between the elements of the above devices.

Referring to FIG. 6, there is illustrated said electric circuit 4 for driving the motor 2 either independently of or concurrently with the heating element 50. The circuit 4 includes a switch means 60 having a pair of serially connected first and second switch contacts 61 and 62, the first switch 61 being connected through a diode bridge 63 to the motor 2 and the second switch 62 connected to the heating element 50 of the PTC heater. These switch contacts are operated by said switch knob 6 which is a three-position slider switch and provided on one side of the housing 1. A combination of capacitors 64 through 67 and coils 68 and 69 is introduced as noise filter means which is connected across the motor 2 with one joint point between two of the capacitors connected to a motor shield 71. Also included in the circuit 4 is a variable resistor 72 which is operated by a dial 70 mounted on the lower end portion of the housing 1 to vary the rotary speed of the motor 2 for adjusting the strength of the vibration imparted to the applicator head 10. The numeral 73 designates a protective resistor.

Figure 10:
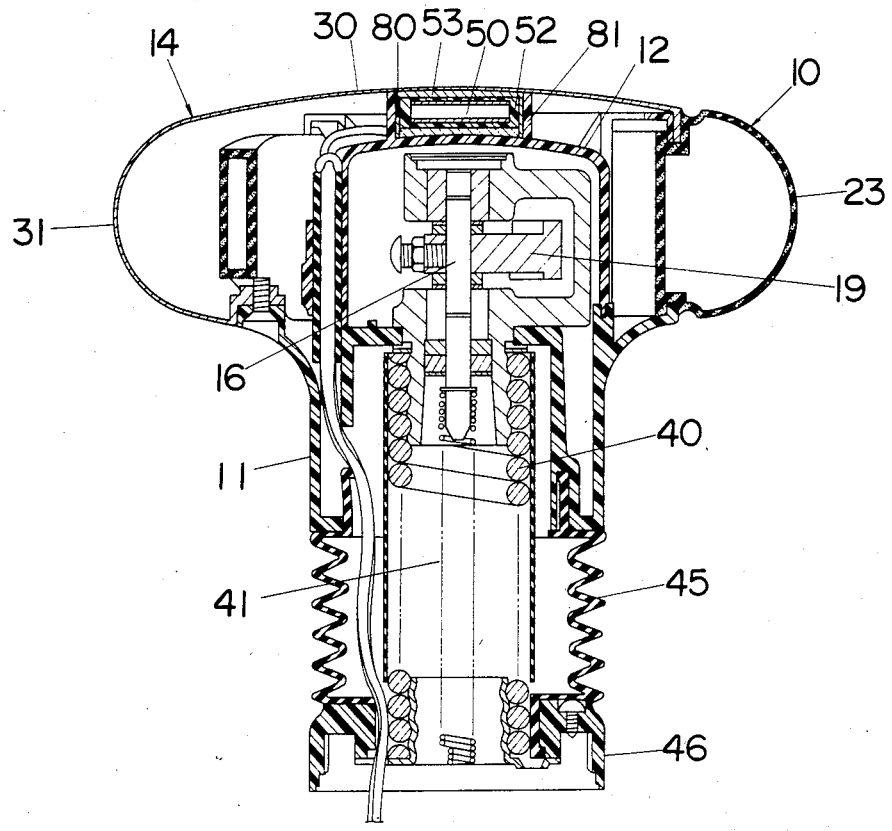
FIG. 10 is a cross sectional view of the applicator head and a connecting shaft means illustrating a modification of the above embodiment.

In operation, when the switch contact 61 is closed while the switch contact 62 remains open, only the motor 2 is energized to vibrate the applicator head 10 with respect to the housing 1, as described above. In this condition, the operator can choose the massage mode or type between the rubbing massage and tapping massage depending upon which one of the top and side faces of the applicator head 10 is placed against the area of the body, that is, the rubbing massage treatment is attained when the top face is selected as illustrated in FIG. 7, and the tapping massage treatment is attained when the side face is selected, as illustrated in FIGS. 8 and 9. It should be noted in the above tapping massage treatment that the operator can enjoy a relatively strong tapping massage force when selecting the rigid side face as the body-contacting surface as in the manner, for example, illustrated in FIG. 9, and enjoy a relatively gentle tapping massage force when selecting the resilient side face as in the manner, for examples, illustrated in FIG. 9. When both switch contacts 61 and 62 are closed, the heating element 50 is energized to add heat to the cover plate 14 of the vibrating applicator head 10, so that the operator can enjoy a combined effect of heating and massage treatments in each of said massaging modes, i.e., in the rubbing massage to select the rigid top face of the applicator head 10 and in the tapping massage to select the rigid side face of the same. With this arrangement, it is successfully achieved that the combined heat-massage treatment can be applied to the area of the body in a most comfortable and effective way depending upon the location and the requirement of the area to be massaged. Referring to FIG. 10, there is illustrated a modification of the above embodiment which is similar to the above embodiment except that the heating element 50 is received in a circular cell 80 surrounded by an integrally formed annular rib 81 projecting upwardly on the center portion of said core cap 12. The heating element 50 is received in said cell 80 together with the mold 52, the cap 53, and the terminal plates of the same construction as in the above embodiment to be centrally positioned in the applicator head 10, such that it will less subject to the effect of the vibrations and therefore be kept securely in place.

The above embodiments and particularly the drawings are set forth for purposes of illustration only. It will be understood that many variations and modifications of the embodiment herein described will be obvious to those skilled in the art, and may be carried out without departing from the spirit and scope of the invention.

What is claimed is:

1. A vibratory massage device comprising:

an elongated housing adapted to fit the user's hand and enclosing an electric motor, the housing being outwardly flared at one end to form an applicator head of fungiform shape;

the applicator head having a generally flat to face, a portion thereof being rigid and of good thermal conductivity and a side face which is generally C shaped in cross section;

the C shaped side face having a first portion which is rigid and of good thermal conductivity extending part way circumferentially around the applicator head and a second portion which is resilient and etends around the remainder of the circumference of the applicator head;

a positive temperature coefficient electric heating element within the applicator head and disposed closely adjacent the underside of the rigid portion thereof, and in good thermal conductive contact therewith;

an eccentric weight mounted for rotation within said applicator head about an axis perpendicular to the generally flat top face and means connecting the weight to the motor for rotation thereby;

the rotation of the eccentric weight being such as to cause a rubbing massage when the generally flat end face is contacted by the user and a tapping massage action when either the rigid or resilient side faces are contacted by the user.

* * * * *